US011628481B2

(12) United States Patent
Kamimiyada et al.

(10) Patent No.: US 11,628,481 B2
(45) Date of Patent: Apr. 18, 2023

(54) CENTRIFUGALLY CAST COMPOSITE ROLL FOR ROLLING AND METHOD OF MANUFACTURING THE SAME

(71) Applicant: NIPPON STEEL ROLLS CORPORATION, Kitakyushu (JP)

(72) Inventors: Kazunori Kamimiyada, Kitakyushu (JP); Shinya Ishikawa, Kitakyushu (JP); Yuji Konno, Kitakyushu (JP)

(73) Assignee: NIPPON STEEL ROLLS CORPORATION, Kitakyushu (JP)

( * ) Notice: Subject to any disclaimer, the term of this patent is extended or adjusted under 35 U.S.C. 154(b) by 43 days.

(21) Appl. No.: 17/600,794

(22) PCT Filed: Mar. 25, 2020

(86) PCT No.: PCT/JP2020/013399
§ 371 (c)(1),
(2) Date: Oct. 1, 2021

(87) PCT Pub. No.: WO2020/203570
PCT Pub. Date: Oct. 8, 2020

(65) Prior Publication Data

US 2022/0176431 A1 Jun. 9, 2022

(30) Foreign Application Priority Data

Apr. 3, 2019 (JP) ..... JP2019-071305

(51) Int. Cl.
*B21B 27/02* (2006.01)
*C21D 5/00* (2006.01)
(Continued)

(52) U.S. Cl.
CPC ..... *B21B 27/02* (2013.01); *C21D 5/00* (2013.01); *C21D 9/38* (2013.01); *C22C 37/08* (2013.01); *C22C 37/10* (2013.01)

(58) Field of Classification Search
CPC ..... B21B 27/02; B21B 27/021; B21B 27/03; B21B 27/032; B22D 3/026; B22D 19/16
See application file for complete search history.

(56) References Cited

U.S. PATENT DOCUMENTS 9,358,758 B2 * 6/2016 Oda ..... C22C 38/06
9,573,176 B2 * 2/2017 Ichino ..... C22C 38/48
(Continued)

FOREIGN PATENT DOCUMENTS

CN 101195890 A 6/2008
CN 105121044 A 12/2015
(Continued)

OTHER PUBLICATIONS

Chinese Office Action and Search Report for corresponding Chinese Application No. 202080026339.2, dated Feb. 8, 2022.
(Continued)

*Primary Examiner* — Jason L Vaughan
(74) *Attorney, Agent, or Firm* — Birch, Stewart, Kolasch & Birch, LLP

(57) ABSTRACT

There is provided a centrifugally cast composite roll for rolling having excellent wear resistance and surface deterioration resistance at levels of a high-speed steel cast iron roll and having rolling incident resistance at a level of a high alloy grain cast iron roll. Its outer layer includes chemical components by mass ratio: C: 1.5 to 3.5%; Si: 0.3 to 3.0%; Mn: 0.1 to 3.0%; Ni: 1.0 to 6.0%; Cr: 1.5 to 6.0%; Mo: 0.1 to 2.5%; V: 2.0 to 6.0%; Nb: 0.1 to 3.0%; B: 0.001 to 0.2%; N: 0.005 to 0.070%; and the balance being Fe and inevitable impurities, wherein: a chemical composition of the outer layer satisfies Formula (1) and has 5 to 30% of $M_3C$ carbide by area ratio; an outer layer Shore hardness (A) of a roll surface satisfies Formula (2); and a residual stress (B) of the roll surface satisfies Formula (3),
(Continued)

$$2\times Ni+0.5\times Cr+Mo>10.0 \quad (1)$$

$$Hs\ 75\leq A\leq Hs\ 85 \quad (2)$$

$$100\ MPa\leq B\leq 350\ MPa \quad (3).$$

4 Claims, 1 Drawing Sheet

(51) Int. Cl.

| | |
|---|---|
| ***C21D 9/38*** | (2006.01) |
| ***C22C 37/08*** | (2006.01) |
| ***C22C 37/10*** | (2006.01) |

(56) References Cited

U.S. PATENT DOCUMENTS

| | | | | |
|---|---|---|---|---|
| 9,708,695 | B2 * | 7/2017 | Ichino | C22C 37/00 |
| 9,757,779 | B2 * | 9/2017 | Oda | C22C 37/08 |
| 9,975,158 | B2 * | 5/2018 | Ichino | B32B 15/011 |
| 11,389,847 | B2 * | 7/2022 | Nozaki | C22C 38/44 |
| 2015/0336353 | A1 | 11/2015 | Oda et al. | |
| 2017/0209906 | A1 * | 7/2017 | Itoh | C22C 38/22 |
| 2019/0366402 | A1 | 12/2019 | Nozaki et al. | |

FOREIGN PATENT DOCUMENTS

| | | | |
|---|---|---|---|
| CN | 108018490 | A | 5/2018 |
| JP | 57-181358 | A | 11/1982 |
| JP | 8-260100 | A | 10/1996 |
| JP | 2000-178675 | A | 6/2000 |
| JP | 2001-150006 | A | 6/2001 |
| JP | 2005-246391 | A | 9/2005 |
| JP | 4483585 | B2 | 6/2010 |
| JP | 5768947 | B2 | 8/2015 |
| JP | 6313844 | B1 | 4/2018 |
| WO | WO 2018/147370 | A1 | 8/2018 |

OTHER PUBLICATIONS

Indian Office Action for corresponding Indian Application No. 202117046925, dated Mar. 28, 2022, with English translation.

* cited by examiner

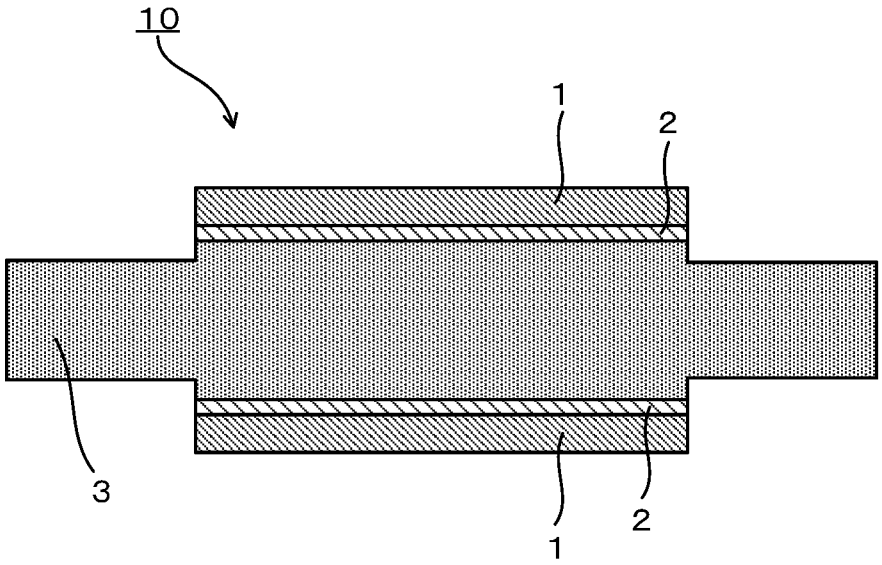
10
1
2
3
1
2

CENTRIFUGALLY CAST COMPOSITE ROLL FOR ROLLING AND METHOD OF MANUFACTURING THE SAME

CROSS-REFERENCE TO RELATED APPLICATIONS

This application is based upon and claims the benefit of priority of the prior Japanese Patent Application No. 2019-071305, filed in Japan on Apr. 3, 2019, the entire contents of which are incorporated herein by reference.

TECHNICAL FIELD

The present invention relates to a centrifugally cast composite roll for rolling used in a hot strip mill in a hot rolling process, and a method of manufacturing the same.

BACKGROUND ART

A composite roll for rolling used in a hot strip mill for hot rolling is required to have excellent wear resistance, surface deterioration resistance, crack resistance, and rolling incident resistance in an outer layer in contact with a steel sheet during rolling. In recent years, demands for improvement in sheet thickness accuracy and improvement in surface quality of the hot-rolled steel sheet increase and, particularly, a roll for rolling having high wear resistance is demanded and a high-speed steel cast iron roll is widely used at an earlier stand of a hot finish rolling mill for manufacturing a thin steel sheet. However, at a later stand of the hot finish rolling mill, the sheet thickness is small and therefore a so-called cobble incident in which a material to be rolled overlaps when moving between stands and is bitten between upper and lower rolls is likely to occur, and therefore a high alloy grain cast iron roll has been mainly used.

In such a cobble incident, a crack is initiated in a roll outer layer surface, and the crack develops if the roll is continuously used with the crack left as it is, and may cause a roll fracture or a roll breakage called spalling. Further, when the cobble (chew-ups) incident occurs, the crack has to be removed by grinding the roll surface, so that if the crack is deep, the loss of the roll becomes large. Therefore, an outer layer for a rolling roll less damaged by the crack and excellent in rolling incident resistance (crack resistance) even if the rolling incident occurs, and a composite roll for rolling having the outer layer are expected.

To respond to the demand that the roll achieving both the rolling incident resistance and the wear resistance is expected, Patent Document 1 discloses an outer layer material of roll for hot rolling excellent in sticking resistance having a composition containing, by mass %, C: 1.8 to 3.5%, Si: 0.2 to 2%, Mn: 0.2 to 2%, Cr: 4 to 15%, Mo: 2 to 10%, and V: 3 to 10%, and further containing P: 0.1 to 0.6% and B: 0.05 to 5%, and the balance being Fe and inevitable impurities. Patent Document 1 discloses that it is preferable that the thermal treatments after casting are treatments such as a quenching treatment of quenching the roll by heating to 800° C. to 1080° C. and a tempering treatment at 300 to 600° C. once or more. However, it has turned out that the roll disclosed in Patent Document 1 has such a problem that since the content of P is excessive, P segregates in a grain boundary to cause embrittlement, and such a problem that the roll has eutectic carbide mainly containing $M_2C$ carbide and $M_7C_3$ carbide so that when the cobble incident occurs during rolling, a deep crack is more likely to be initiated in the roll outer layer surface as compared with the case of the high alloy grain cast iron roll. It has further turned out that since an outer layer residual stress value of the roll surface is likely to be excessive, the roll has a problem of a high risk that the crack leads to explosive spalling because of high crack developing speed.

Besides, Patent Document 2 discloses a composite roll for rolling which has a structure obtained by integrally welding an outer layer and an intermediate layer which are formed of a centrifugally cast Fe-based alloy, and an inner layer formed of ductile cast iron, wherein the outer layer has a composition which contains, by mass, 1 to 3% of C, 0.3 to 3% of Si, 0.1 to 3% of Mn, 0.5 to 5% of Ni, 1 to 7% of Cr, 2.2 to 8% of Mo, 4 to 7% of V, 0.005 to 0.15% of N, and 0.05 to 0.2% of B, and the balance being Fe and inevitable impurities, the intermediate layer contains 0.025 to 0.15 mass % of B, a B content ratio in the intermediate layer is 40 to 80% of the B content of the outer layer, and the total content of carbide-forming elements in the intermediate layer is 40 to 90% of the total content of the carbide-forming elements in the outer layer. Patent Document 2 discloses that a quenching treatment is performed as needed after casting and a tempering treatment is performed once or more, and the tempering temperature is preferably 480 to 580° C. However, it has turned out that the roll disclosed in Patent Document 2 has such a problem that the roll has eutectic carbide mainly containing $M_2C$ carbide and $M_7C_3$ carbide so that when the cobble incident or the like occurs during rolling, a deep crack is more likely to be initiated in the roll outer layer surface as compared with the case of the high alloy grain cast iron roll. It has further turned out that since an outer layer residual stress value of the roll surface is likely to be excessive, the roll has a problem of a high risk that the crack leads to explosive spalling because of high crack developing speed.

Further, Patent Document 3 discloses a centrifugally cast composite roll for rolling having an outer layer, the outer layer containing, by mass %, C: 2.2% to 3.01%, Si: 1.0% to 3.0%, Mn: 0.3% to 2.0%, Ni: 3.0% to 7.0%, Cr: 0.5% to 2.5%, Mo: 1.0% to 3.0%, V: 2.5% to 5.0%, Nb: more than 0 and 0.5% or less, and the balance being Fe and inevitable impurities, and satisfying a condition (a): Nb %/V %<0.1 and a condition (b): 2.1×C %+1.2×Si %−Cr %+0.5×Mo %+(V %+Nb %/2)≤13.0%. Patent Document 3 discloses that a solution heat treatment at 850° C. or higher, quenching, and tempering may be performed. However, it has turned out that the roll disclosed in Patent Document 3 has such a problem that the roll is significantly inferior in wear resistance to a high-speed steel cast iron roll and that when the cobble incident or the like occurs during rolling, a deep crack is more likely to be initiated in the roll outer layer surface as compared with the case of the high alloy grain cast iron roll. It has further turned out that since an outer layer residual stress value of the roll surface is likely to be excessive, the roll has a problem of a high risk that the crack leads to explosive spalling because of high crack developing speed.

Further, Patent Document 4 discloses a centrifugally cast composite roll for hot rolling composed of: an outer layer made of cast iron having a chemical composition containing, by mass, C: 2.5% to 3.5%, Si: 1.3% to 2.4%, Mn: 0.2% to 1.5%, Ni: 3.5% to 5.0%, Cr: 0.8% to 1.5%, Mo: 2.5% to 5.0%, V: 1.8% to 4.0%, and Nb: 0.2% to 1.5%, and the balance being Fe and inevitable impurities and having an Nb/V mass ratio of 0.1 to 0.7 and a Mo/V mass ratio of 0.7 to 2.5, and satisfying conditions of 2.5≤V+1.2 and Nb≤5.5, and a structure containing 0.3 to 10% of a graphite phase by area ratio; an axial core part made of ductile cast iron; and an intermediate layer made of cast iron. Patent Document 4 discloses that the compressive residual stress of the outer layer in a disposal diameter is 150 to 500 MPa and that a quenching treatment at 450 to 550° C. is performed once or more after casting in order to obtain the compressive residual stress. However, it has turned out that the roll disclosed in Patent Document 4 has such a problem that the roll has an excessive additive amount of Mo and is thus formed of eutectic carbide mainly containing $M_2C$ carbide so that when the cobble incident or the like occurs during rolling, a deep crack is more likely to be initiated in the roll outer layer surface as compared with the case of the high alloy grain cast iron roll. It has further turned out that since an outer layer residual stress value of the roll surface is likely to be excessive, the roll has a problem of a high risk that the crack leads to explosive spalling because of high crack developing speed.

PRIOR ART DOCUMENT

Patent Document

Patent Document 1: Japanese Patent No. 4483585
Patent Document 2: International Publication Pamphlet No. WO 2018/147370
Patent Document 3: Japanese Patent No. 6313844
Patent Document 4: Japanese Patent n No. 5768947

DISCLOSURE OF THE INVENTION

Problems to be Solved by the Invention

However, it has turned out that the rolls disclosed in the above Patent Documents 1 to 4 each have such a problem that when the cobble incident or the like occurs during rolling, a deep crack is more likely to be initiated in the roll outer layer surface as compared with the case of the high alloy grain cast iron roll. It has further turned out that since an outer layer residual stress value of the roll surface is likely to be excessive, the roll has a problem of a high risk that the crack leads to explosive spalling because of high crack developing speed.

In consideration of the above circumstances, an object of the present invention is to provide a centrifugally cast composite roll for rolling having excellent wear resistance and surface deterioration resistance at levels of a high-speed steel cast iron roll and having rolling incident resistance at a level of a high alloy grain cast iron roll, and a method of manufacturing the same.

Means for Solving the Problems

In order to achieve the above object, the present invention provides a centrifugally cast composite roll for rolling having an outer layer, the outer layer including chemical components by mass ratio:

C: 1.5 to 3.5%;
Si: 0.3 to 3.0%;
Mn: 0.1 to 3.0%;
Ni: 1.0 to 6.0%;
Cr: 1.5 to 6.0%;
Mo: 0.1 to 2.5%;
V: 2.0 to 6.0%;
Nb: 0.1 to 3.0%;
B: 0.001 to 0.2%;
N: 0.005 to 0.070%; and the balance being Fe and inevitable impurities, wherein:

a chemical composition of the outer layer satisfies following Formula (1) and has 5 to 30% of $M_3C$ carbide by area ratio;

an outer layer Shore hardness (A) of a roll surface satisfies following Formula (2); and a residual stress (B) of the roll surface satisfies following Formula (3), $$2\times Ni+0.5\times Cr+Mo>10.0 \quad (1)$$

$$Hs75\leq A\leq Hs85 \quad (2)$$

$$100\ MPa\leq B\leq 350\ MPa \quad (3).$$

The outer layer may further include one or more of chemical components by mass ratio:

Ti: 0.005 to 0.3%;
W: 0.01 to 2.0%;
Co: 0.01 to 2.0%; and
S: 0.3% or less.

Further, a present invention from another aspect provides a method of manufacturing the above centrifugally cast composite roll for rolling, wherein in a thermal treatment performed after casting by a centrifugal casting method, a tempering treatment is performed without performing a quenching treatment, the tempering treatment being performed at a tempering temperature of 400° C. or higher and 550° C. or lower.

Effect of the Invention

According to the present invention, when a crack is initiated in an outer layer surface during rolling in a centrifugally cast composite roll for rolling composed of an outer layer having more excellent wear resistance than the conventional high alloy grain cast iron roll, it is possible to suppress such a trouble that the crack develops to lead to cracking such as spalling. In other words, it is possible to make the centrifugally cast composite roll for rolling have both the wear resistance and surface deterioration resistance at levels of the high-speed steel cast iron roll and the rolling incident resistance at a level of the high alloy grain cast iron roll. The centrifugally cast composite roll for rolling according to the present invention is suitably applied especially to a later stand of hot finish rolling required to have operational stability in a hot strip mill.

BRIEF DESCRIPTION OF THE DRAWINGS

FIG. 1 is a schematic sectional view of a centrifugally cast composite roll for rolling according to an embodiment.

EMBODIMENTS FOR CARRYING OUT THE INVENTION

Hereinafter, an embodiment of the present invention will be explained referring to the drawings. Note that the same codes are given to components having substantially the same functional configurations in the description and the drawings to omit duplicated explanation.

FIG. 1 is a schematic sectional view of a centrifugally cast composite roll for rolling 10 according to an embodiment of the present invention. As illustrated in FIG. 1, the centrifugally cast composite roll for rolling according to the present invention has an outer layer 1 to be provided for rolling, and further has an intermediate layer 2 and an inner layer (axial core material) 3 inside the outer layer 1. Examples of an inner layer material constituting the inner layer (axial core material) 3 include materials having toughness such as high-grade cast iron, ductile cast iron and the like, and examples of an intermediate layer material constituting the intermediate layer 2 include an adamite material and graphitic steel.

The outer layer 1 made by centrifugal casting is formed of an Fe-based alloy containing, by mass ratio, 1.5 to 3.5% of C, 0.3 to 3.0% of Si, 0.1 to 3.0% of Mn, 1.0 to 6.0% of Ni, 1.5 to 6.0% of Cr, 0.1 to 2.5% of Mo, 2.0 to 6.0% of V, 0.1 to 3.0% of Nb, 0.001 to 0.2% of B, and 0.005 to 0.070% of N, and the balance being Fe and inevitable impurities.

Further, the structure of the outer layer 1 is composed of (a) MC carbide, (b) eutectic carbide, (c) matrix, and (d) other, in which the (b) eutectic carbide has 5 to 30% of $M_3C$ carbide by area ratio. Further, $M_2C$ carbide, $M_6C$ carbide, and $M_7C_3$ carbide may be contained in addition to the $M_3C$ carbide, but the presence of the $M_2C$ carbide, the $M_6C$ carbide, and the $M_7C_3$ carbide is not essential. Furthermore, the structure of the outer layer may contain graphite, but the presence of graphite is not essential.

(Reasons for Limiting Components)

Hereinafter, reasons for limiting chemical components of the outer layer according to the present invention will be explained first. Note that the expression of "%" represents "mass %" hereinafter unless otherwise described.

C: 1.5 to 3.5%

C mainly combines with Fe, Cr, Mo, Nb, V, W and the like to form various hard carbides. Besides, C may form graphite in some cases. Further, C forms a solid solution with a matrix to produce pearlite, bainite, and martensite phases and the like. A larger amount of C contained is more effective in improvement in wear resistance, but when C exceeds 3.5%, coarse carbide or graphite is formed, causing a decrease in toughness and causing surface deterioration. Besides, when C is less than 1.5%, the amount of carbide is little and the securement of hardness is difficult, causing deterioration in wear resistance. Accordingly, the range of C is set to 1.5 to 3.5%. A more preferable range is 2.0 to 3.0%.

Si: 0.3 to 3.0%

Si is necessary for suppressing generation of a defect of an oxide owing to deoxidation of a molten metal. Further, Si has an action of improving the fluidity of the molten metal to prevent a cast defect. Further, when graphite is crystallized and precipitated in the high alloy grain cast iron or the like, Si is necessary as an element for accelerating crystallization and precipitation of graphite.

Accordingly, 0.3% or more of Si is contained. However, when exceeding 3.0%, Si decreases the toughness, causing a decrease in crack resistance. Accordingly, the range of Si is set to 0.3 to 3.0%. A more preferable range is 0.6 to 2.7%.

Mn: 0.1 to 3.0%

Mn is added for a purpose of deoxidizing and desulfurizing actions. Further, Mn combines with S to form MnS. MnS has a lubrication action and thus has an effect in preventing sticking of a material to be rolled. Therefore, it is preferable that MnS is contained in a range of causing no side effect. When Mn is less than 0.1%, these effects are insufficient, whereas when Mn exceeds 3.0%, the toughness decreases. Accordingly, the range of Mn is set to 0.1 to 3.0%. A more preferable range is 0.5 to 1.5%.

Ni: 1.0 to 6.0%

Ni has an action of improving the hardenability of the matrix and is an element which prevents the formation of pearlite during cooling and accelerates bainitization and is thereby effective in strengthening the matrix, and therefore 1.0% or more of Ni needs to be contained. However, when more than 6.0% of Ni is contained, the amount of retained austenite is excessive to make it difficult to secure the hardness and may cause deformation or the like during use for hot rolling in some cases. Accordingly, the range of Ni is set to 1.0 to 6.0%. A more preferable range is 2.0 to 5.5%.

Cr: 1.5 to 6.0%

Cr is added for increasing the hardenability, increasing the hardness, increasing the resistance to temper softening, stabilizing the carbide hardness, and so on. However, when Cr exceeds 6.0%, the amount of eutectic carbide becomes excessive to decrease the toughness, and therefore the upper limit is set to 6.0%. On the other hand, when Cr is less than 1.5%, the above effects cannot be obtained any longer. Accordingly, the range of Cr is set to 1.5 to 6.0%. A more preferable range is 1.55 to 5.0%.

Mo: 0.1 to 2.5%

Mo combines mainly with C to form hard carbide to contribute to the improvement in wear resistance and to improve the hardenability of the matrix, and therefore at least 0.1% or more of Mo needs to be contained. On the other hand, when Mo exceeds 2.5%, the crystallization amount of the $M_3C$ carbide being one of the purposes of the present invention decreases. Accordingly, the range of Mo is set to 0.1 to 2.5%. A more preferable range is 0.5 to 2.45%.

V: 2.0 to 6.0%

V is an element important especially for improving the wear resistance. More specifically, V is an important element which combines with C to form high-hardness MC carbide greatly contributing to the wear resistance. When V is less than 2.0%, the amount of MC carbide is insufficient and the improvement in wear resistance is insufficient, whereas when V exceeds 6.0%, it becomes a region where low-density MC carbide independently crystallizes as a primary crystal. In the case of manufacture by the centrifugal casting method, the density of the MC carbide is lower than the density of the molten metal, so that the gravity segregation significantly occurs. Accordingly, the range of V is set to 2.0 to 6.0%. A more preferable range is 3.0 to 5.0%.

Nb: 0.1 to 3.0%

Most of Nb does not form a solid solution with the matrix, and most of Nb forms high-hardness MC carbide to improve the wear resistance. In particular, the MC carbide produced by the addition of Nb is smaller in difference from the molten metal density than is the MC carbide produced by the addition of V, and therefore has an effect of reducing the gravity segregation owing to the centrifugal casting. When the content of Nb is less than 0.1%, the effect is insufficient, whereas when the content exceeds 3.0%, the MC carbide becomes coarse, leading to a decrease in toughness. Accordingly, the range of Nb is set to 0.1 to 3.0%.

B: 0.001 to 0.2%

B forms a solid solution with carbide and forms a borocarbide. The borocarbide has a lubrication action and has an effect in preventing sticking of a material to be rolled. When the content of B is less than 0.001%, the effect is insufficient, whereas when the content exceeds 0.2%, the toughness decreases. Accordingly, the range of B is set to 0.001 to 0.2%.

N: 0.005 to 0.070%

N has an effect of fining the carbide, and combines with V to form a nitride (VN) or a carbonitride (VCN). When N is less than 0.005%, the effect of fining the carbide is insufficient, whereas when the content of N exceeds 0.070%, excessive nitride (VN) or carbonitride (VCN) is formed to decrease the toughness, and therefore N needs to be suppressed to 0.070% or less. Accordingly, the range of N is set to 0.005 to 0.070%.

The basic components of the outer layer according to the present invention are as above, and the following chemical components may be appropriately selected and contained as other chemical components, in addition to the above basic components, depending on the size of the roll to be applied, the required usage characteristics of the roll and so on.

Ti: 0.005 to 0.3%

The centrifugally cast composite roll for rolling according to the present invention can contain Ti in addition to the above essential elements. Ti can be expected to have a degassing action with N and O, and can form TiCN or TiC to become a crystallization nucleus of the MC carbide. When the content of Ti is less than 0.005%, the effect cannot be expected, whereas when the content exceeds 0.3%, the viscosity of the molten metal becomes high to increase the risk of inducing a cast defect. Accordingly, in the case of adding Ti, its range is set to 0.005 to 0.3%. A more preferable range is 0.01 to 0.2%.

W: 0.01 to 2.0%

The centrifugally cast composite roll for rolling according to the present invention can contain W in addition to the above essential elements. W forms a solid solution with the matrix similarly to Mo to strengthen the matrix, and combines with C to form hard eutectic carbide such as $M_2C$ or $M_6C$ to contribute to the improvement in wear resistance. To strengthen the matrix, the content of at least 0.01% or more is necessary, but when the content exceeds 2.0%, coarse eutectic carbide is formed to decrease the toughness. Accordingly, in the case of adding W, its range is set to 0.01 to 2.0%. Note that about the selection whether to add W or not, for example, when W is added in the case of achieving the improvement in wear resistance by increasing the amount of eutectic carbide, the effect is higher.

Co: 0.01 to 2.0%

The centrifugally cast composite roll for rolling according to the present invention can contain Co in addition to the above essential elements. Most of Co forms a solid solution with the matrix to strengthen the matrix. Therefore, Co has an action of improving the hardness and strength at high temperature. When Co is less than 0.01%, the effect is insufficient, whereas when Co exceeds 2.0%, the effect is saturated, and therefore Co is set to 2.0% or less also from a viewpoint of economical efficiency. Accordingly, in the case of adding Co, its range is set to 0.01 to 2.0%. Note that about the selection whether to add Co or not, for example, when Co is added in the case where the improvement in wear resistance is required and the increase in amount of the eutectic carbide is difficult, the effect is higher.

S: 0.3% or Less

Generally, S is inevitably mixed to a certain degree from a raw material, and S forms MnS and has a lubrication action as explained above and thus has an effect of preventing the sticking of a rolled steel material. On the other hand, when S is excessively contained, the material becomes brittle, and therefore it is preferable to limit S to 0.3% or less.

Inevitable Impurities

The composition of the outer layer of the centrifugally cast composite roll for rolling according to the present invention is composed of the above elements and the balance being substantially Fe and inevitable impurities. In the inevitable impurities, P deteriorates the toughness and therefore it is preferable to limit P to 0.1% or less. Further, as the other inevitable impurities, elements such as Cu, Sb, Sn, Zr, Al, Te, Ce and the like may be contained in a range not impairing the characteristics of the outer layer. In order not to impair the characteristics of the outer layer, the total amount of the inevitable impurities is preferably 0.6% or less.

(Relational Expression Relating to the Chemical Composition)

Further, regarding the chemical components (chemical composition) of the outer layer of the centrifugally cast composite roll for rolling according to the present invention, the present invention next needs to satisfy the following Formula (1) regarding the contents (%) of Ni, Cr, Mo when adding V, Nb, Mo, Cr which are especially hard carbide-forming elements.

$$2\times Ni+0.5\times Cr+Mo>10.0 \quad (1)$$

The outer layer of the centrifugally cast composite roll for rolling according to the present invention is characterized by having 5 to 30% of the $M_3C$ carbide by area ratio as an element constituting a microstructure and characterized by being subjected to a tempering treatment without a quenching treatment, the tempering treatment being performed at a tempering temperature of 400° C. or higher and 550° C. or lower. In the case of applying the above conditions, there has been such a problem in the prior art that it is extremely difficult to stably control the outer layer Shore hardness (Hs) of the roll surface to a range of 75 to 85.

The present invention has found out that in the case of applying the conditions that 5 to 30% of the $M_3C$ carbide by area ratio is contained as the element constituting the outer layer of the microstructure and that a tempering treatment is performed without performing a quenching treatment, the tempering treatment being performed at a tempering temperature of 400° C. or higher and 550° C. or lower, it becomes possible to stably control the outer layer Shore hardness (Hs) of the surface of the centrifugally cast composite roll for rolling to a range of 75 to 85 by satisfying the Formula (1) in the chemical components (chemical composition) of the outer layer of the centrifugally cast composite roll for rolling according to the present invention. This makes it possible to provide a roll achieving both the wear resistance and the rolling incident resistance (crack resistance) at high levels.

(Thermal Treatment after Casting by the Centrifugal Casting Method)

The centrifugally cast composite roll for rolling according to the present invention is manufactured by a general centrifugal casting method, and the present inventors have obtained the knowledge that it is preferable to perform a tempering treatment without performing a quenching treatment, regarding the thermal treatment performed after the casting in the centrifugal casting method. It has been further found out that it is preferable to perform the tempering treatment at a tempering temperature of 400° C. or higher and 550° C. or lower. In other words, it has turned out that the tempering treatment is performed at a tempering temperature of 400° C. or higher and 550° C. or lower without performing the quenching treatment of heating the roll to a range where the Fe matrix transforms to austenite and then rapidly cooling it, whereby a Shore hardness at a level of the high-speed steel cast iron roll can be secured at the outer layer surface and the residual stress value of a body portion outer layer surface can be suppressed to a level of the high alloy grain cast iron roll.

As explained above, by performing a tempering treatment without performing a quenching treatment and setting the tempering temperature to 400° C. or higher and 550° C. or lower, a Shore hardness (A) of the outer layer of the centrifugally cast composite roll for rolling according to the present invention satisfies the following Formula (2). Further, a residual stress (B) of the outer layer surface of the centrifugally cast composite roll for rolling according to the present invention satisfies the following Formula (3).

$$Hs75 \leq A \leq Hs85 \quad (2)$$

$$100\ MPa \leq B \leq 350\ MPa \quad (3)$$

(Content of the $M_3C$ Carbide)

Further, the outer layer of the centrifugally cast composite roll for rolling according to the present invention needs to contain 5 to 30% of the $M_3C$ carbide by area ratio. The present inventors have found out that it is effective that the $M_3C$ carbide exists at a predetermined ratio in the microstructure component of the outer layer in order to give the rolling incident resistance at a level of the high alloy grain cast iron roll to the centrifugally cast composite roll for rolling having the wear resistance at a level of the high-speed steel roll, as a result of research and examination of the usage status of the centrifugally cast roll provided for hot rolling. When the amount of the $M_3C$ carbide existing in the outer layer is less than 5% by area ratio, the wear resistance deteriorates and the securement of the rolling incident resistance at a level of the high alloy grain cast iron roll becomes difficult. Besides, when the amount of the $M_3C$ carbide exceeds 30% by area ratio, the $M_3C$ carbide coarsely crystallizes and inversely deteriorates the rolling incident resistance, so that the amount of the $M_3C$ carbide is defined to 5 to 30% by area ratio.

(Action and Effect)

As explained above, the centrifugally cast composite roll for rolling according to the present invention is configured to have the above predetermined components as the chemical composition of the outer layer, satisfy the above Formula (1), and contain 5 to 30% of the $M_3C$ carbide by area ratio, and thereby has a Shore hardness satisfying the above Formula (2) and has suppressed residual stress satisfying the above Formula (3). This realizes the centrifugally cast composite roll for rolling having excellent wear resistance and surface deterioration resistance at levels of the high-speed steel cast iron roll and having the rolling incident resistance at a level of the high alloy grain cast iron roll.

An embodiment of the present invention has been explained, but the present invention is not limited to the embodiment. It should be understood that various changes and modifications are readily apparent to those skilled in the art within the scope of the spirit as set forth in claims, and those should also be covered by the technical scope of the present invention.

Examples

Composite rolls composed of chemical components listed in the following Table 1, namely, Nos. 1 to 16 (present invention examples) and 17 to 28 (comparative examples) were produced as composite rolls for hot finish stand rolling having an inner layer diameter of 600 mm, a roll outer diameter of 800 mm, an outer layer thickness of 100 mm, and a body length of 2400 mm by the centrifugal casting method. The melting temperature is 1550° C., and a casting temperature is a freezing point+90° C. After the casting, the tempering treatment was carried out at tempering temperatures listed in Table 1.

Note that the underlined portions in Table 1 indicate the case where the chemical component of the outer layer is out of a predetermined range explained in the above embodiment, the case where the above Formula (1) is not satisfied, and the case where the tempering temperature is out of the predetermined range. Further, regarding the outer layer surface Shore hardness in Table 1, a mark ○ indicates that it is within a scope of the present invention (Hs: 75 to 85), and × indicates that it is out of the scope of the present invention. Regarding the outer layer surface residual stress, a mark ○ indicates that it is within a scope of the present invention (100 MPa to 350 MPa), and × indicates that it is out of the scope of the present invention. Further, regarding the $M_3C$ carbide area ratio, a mark ○ indicates that it is within a scope of the present invention (area ratio: 5 to 30%), and × indicates that it is out of the scope of the present invention.

TABLE 1

| | OUTER LAYER COMPONENT(mass %) | | | | | | | | | | | | | | |
|---|---|---|---|---|---|---|---|---|---|---|---|---|---|---|---|
| No. | C | Si | Mn | Ni | Cr | Mo | V | Nb | B | N | Ti | W | Co | S | FORMULA(1) |
| 1 | 2.08 | 1.33 | 0.74 | 2.65 | 5.23 | 2.41 | 3.10 | 0.65 | 0.058 | 0.054 | — | — | — | — | 10.3 |
| 2 | 3.26 | 2.45 | 1.38 | 4.38 | 1.87 | 1.32 | 2.80 | 1.35 | 0.061 | 0.068 | — | — | — | — | 11.0 |
| 3 | 2.73 | 0.95 | 0.10 | 4.77 | 1.55 | 1.05 | 4.00 | 1.89 | 0.061 | 0.063 | — | — | — | 0.07 | 11.4 |
| 4 | 2.35 | 2.02 | 0.45 | 5.13 | 4.55 | 0.75 | 5.90 | 1.18 | 0.009 | 0.047 | — | — | — | 0.12 | 13.3 |
| 5 | 2.76 | 1.17 | 0.79 | 3.57 | 4.50 | 1.85 | 3.00 | 0.99 | 0.052 | 0.032 | — | — | — | 0.08 | 11.2 |
| 6 | 3.06 | 2.68 | 0.81 | 2.56 | 5.51 | 2.45 | 2.30 | 1.89 | 0.047 | 0.021 | — | — | — | — | 10.3 |
| 7 | 2.52 | 2.23 | 0.67 | 4.67 | 4.13 | 0.21 | 2.10 | 1.68 | 0.087 | 0.055 | — | 1.53 | — | — | 11.6 |
| 8 | 2.96 | 0.76 | 0.86 | 4.47 | 1.65 | 1.56 | 5.80 | 1.75 | 0.171 | 0.054 | 0.023 | — | — | — | 11.3 |
| 9 | 2.28 | 2.95 | 0.72 | 4.98 | 1.92 | 0.68 | 2.24 | 0.85 | 0.063 | 0.068 | 0.020 | — | — | — | 11.6 |
| 10 | 2.12 | 2.77 | 0.86 | 5.66 | 1.58 | 0.28 | 2.50 | 0.62 | 0.032 | 0.070 | 0.150 | 0.21 | — | — | 12.4 |
| 11 | 1.65 | 2.88 | 0.81 | 3.67 | 3.38 | 1.98 | 3.10 | 1.67 | 0.028 | 0.045 | 0.018 | — | — | — | 11.0 |
| 12 | 1.95 | 1.81 | 0.73 | 4.92 | 2.06 | 0.75 | 2.80 | 1.35 | 0.019 | 0.028 | 0.280 | — | — | — | 11.6 |
| 13 | 1.87 | 2.86 | 0.68 | 3.25 | 5.79 | 1.87 | 4.00 | 1.78 | 0.110 | 0.015 | 0.030 | 1.85 | — | — | 11.3 |
| 14 | 2.63 | 0.82 | 1.89 | 5.28 | 1.78 | 1.02 | 5.90 | 1.89 | 0.045 | 0.068 | 0.012 | 0.78 | — | — | 12.5 |
| 15 | 2.80 | 1.78 | 0.25 | 4.50 | 2.01 | 0.98 | 3.00 | 1.57 | 0.058 | 0.035 | — | 1.63 | 1.12 | — | 11.0 |
| 16 | 3.25 | 2.36 | 0.77 | 5.02 | 1.68 | 2.14 | 2.30 | 1.73 | 0.061 | 0.024 | — | — | — | — | 13.0 |
| 17 | 1.87 | 2.37 | 0.65 | 2.55 | 1.03 | 2.51 | 1.80 | 0.62 | 0.110 | 0.089 | — | — | — | — | 8.1 |
| 18 | 2.78 | 1.26 | 0.83 | 4.07 | 1.63 | 0.51 | 5.80 | 0.99 | 0.045 | 0.118 | — | — | — | — | 9.5 |
| 19 | 2.45 | 1.65 | 0.51 | 1.18 | 5.53 | 3.22 | 5.30 | 1.89 | 0.061 | 0.068 | — | — | — | — | 8.3 |
| 20 | 3.45 | 0.52 | 0.66 | 4.77 | 6.20 | 1.08 | 3.80 | 1.68 | 0.009 | 0.070 | — | — | — | — | 13.7 |
| 21 | 2.60 | 1.82 | 0.71 | 2.08 | 1.21 | 3.56 | 5.80 | 1.75 | 0.052 | 0.095 | — | — | — | — | 8.3 |
| 22 | 3.22 | 2.01 | 0.65 | 4.48 | 2.01 | 0.98 | 4.80 | 0.71 | 0.047 | 0.091 | — | — | — | — | 10.9 |
| 23 | 3.60 | 3.13 | 2.05 | 3.99 | 1.85 | 1.63 | 1.80 | 0.05 | 0.082 | 0.086 | — | — | — | — | 10.5 |
| 24 | 2.63 | 2.36 | 0.95 | 4.95 | 1.43 | 1.26 | 3.48 | 1.23 | 0.052 | 0.025 | — | — | — | — | 11.9 |
| 25 | 1.40 | 2.35 | 0.95 | 3.83 | 3.46 | 0.85 | 3.65 | 0.87 | 0.040 | 0.062 | — | — | — | — | 10.2 |
| 26 | 2.75 | 2.36 | 0.80 | 6.13 | 1.78 | 1.35 | 3.37 | 0.56 | 0.037 | 0.028 | — | — | — | — | 14.5 |

TABLE 1-continued

| | | | | | | | | | | | | | | | |
|---|---|---|---|---|---|---|---|---|---|---|---|---|---|---|---|
| 27 | 2.21 | 1.85 | 1.83 | 3.65 | 1.63 | 2.55 | 4.12 | 0.37 | 0.078 | 0.063 | — | — | — | — | 10.7 |
| 28 | 2.24 | 2.61 | 0.98 | 4.58 | 5.42 | 0.98 | 3.25 | 1.56 | 0.034 | 0.025 | 0.015 | 0.15 | — | — | 12.9 |

| | HEAT TREATMENT CONDITION | | OUTER LAYER | OUTER LAYER | M3C | |
|---|---|---|---|---|---|---|
| No. | PRESENCE OF ABSENCE OE QUENCHING | TEMPERING TEMPERATURE(° C.) | SURFACE SHORE HARDNESS | SURFACE RESIDUAL STRESS | CARBIDE AREA RATIO | NOTE |
| 1 | x ABSENT | 510 | ○ | ○ | ○ | PRESENT INVENTION EXAMPLE |
| 2 | x ABSENT | 450 | ○ | ○ | ○ | |
| 3 | x ABSENT | 420 | ○ | ○ | ○ | |
| 4 | x ABSENT | 485 | ○ | ○ | ○ | |
| 5 | x ABSENT | 435 | ○ | ○ | ○ | |
| 6 | x ABSENT | 480 | ○ | ○ | ○ | |
| 7 | x ABSENT | 475 | ○ | ○ | ○ | |
| 8 | x ABSENT | 455 | ○ | ○ | ○ | |
| 9 | x ABSENT | 470 | ○ | ○ | ○ | |
| 10 | x ABSENT | 530 | ○ | ○ | ○ | |
| 11 | x ABSENT | 510 | ○ | ○ | ○ | |
| 12 | x ABSENT | 455 | ○ | ○ | ○ | |
| 13 | x ABSENT | 435 | ○ | ○ | ○ | |
| 14 | x ABSENT | 500 | ○ | ○ | ○ | |
| 15 | x ABSENT | 480 | ○ | ○ | ○ | |
| 16 | x ABSENT | 470 | ○ | ○ | ○ | |
| 17 | x ABSENT | 480 | x | ○ | x | COMPARATIVE EXAMPLE |
| 18 | ○PRESENT | 535 | ○ | x | x | |
| 19 | ○PRESENT | 480 | ○ | x | x | |
| 20 | ○PRESENT | 450 | ○ | x | x | |
| 21 | x ABSENT | 470 | x | ○ | x | |
| 22 | x ABSENT | 380 | x | ○ | x | |
| 23 | x ABSENT | 450 | x | ○ | x | |
| 24 | x ABSENT | 525 | x | ○ | ○ | |
| 25 | x ABSENT | 480 | x | ○ | x | |
| 26 | x ABSENT | 450 | x | ○ | ○ | |
| 27 | x ABSENT | 520 | ○ | ○ | x | |
| 28 | x ABSENT | 570 | x | ○ | x | |

Thereafter, the Shore hardness of the body portion outer layer surface was measured in the composite roll, and it was researched whether the Shore hardness (Hs: 75 to 85) at a level of the high-speed steel cast iron roll was able to be secured or not. Further, the residual stress value at the body portion outer layer surface was measured by X-ray, and it was researched whether the residual stress value was 100 MPa to 350 MPa at a level of the high alloy grain cast iron roll. Furthermore, the area ratio of the $M_3C$ carbide in the structure of a test piece sampled from the roll body portion was measured, and it was researched whether the area ratio was within 5 to 30%. For the measurement of the area ratio of the $M_3C$ carbide, it was necessary to discriminate the $M_3C$ carbide from the other eutectic carbide ($M_2C$ carbide, $M_6C$ carbide, $M_7C_3$ carbide, and so on), so that the element mapping function of an EPMA (Electron Probe Micro Analyzer) was used to capture an image (magnification: 100 times) in which only the $M_3C$ carbide was extracted, and the area ratio of the $M_3C$ carbide in the image was measured by image analysis software.

As a result, in the rolls in the present invention examples Nos. 1 to 16 in each of which the chemical components of the outer layer were within the predetermined ranges explained in the embodiment and the conditions relating to the above Formula (1) and the tempering temperature were within the scope of the present invention, it was confirmed that when a crack occurred in the outer layer surface during rolling, the body portion outer layer surface Shore hardness (Hs: 75 to 85) and the residual stress value (100 MPa to 350 MPa) being conditions under which the crack developing speed was able to be suppressed to a level of the high alloy grain cast iron roll were satisfied. It was further confirmed that the area ratio (5 to 30%) of the $M_3C$ carbide in the microstructure component of the outer layer being the condition for having the wear resistance at a level of the high-speed steel cast iron roll and giving the rolling incident resistance at a level of the high alloy grain cast iron roll was satisfied.

On the other hand, in the rolls in the comparative examples Nos. 17 to 28 in each of which the chemical components of the outer layer were out of the predetermined ranges explained in the embodiment and the conditions relating to the above Formula (1) and the tempering temperature were out of the scope of the present invention, it was confirmed that when a crack occurred in the outer layer surface during rolling, any one of the body portion outer layer surface Shore hardness (Hs: 75 to 85) and the residual stress value (100 MPa to 350 MPa) being conditions under which the crack developing speed was able to be suppressed to a level of the high alloy grain cast iron roll and the area ratio (5 to 30%) of the $M_3C$ carbide in the microstructure component of the outer layer being the condition for having the wear resistance at a level of the high-speed roll and giving the rolling incident resistance at a level of the high alloy grain cast iron roll was not satisfied.

From the above-explained results of the examples, it is found that the centrifugally cast composite roll for rolling is configured to have chemical components of the outer layer within the predetermined ranges, to be defined to satisfy the above Formula (1), and to contain 5 to 30% of the $M_3C$ carbide by area ratio and thereby can be made to have a Shore hardness of the roll surface and a residual stress in desired ranges, thereby realizing a centrifugally cast composite roll for rolling having excellent wear resistance and surface deterioration resistance at levels of the high-speed steel cast iron roll and having rolling incident resistance at a level of the high alloy grain cast iron roll.

INDUSTRIAL APPLICABILITY

The present invention is applicable to a centrifugally cast composite roll for rolling used in a hot strip mill in a hot rolling process, and a method of manufacturing the same.

EXPLANATION OF CODES

1 outer layer
2 intermediate layer
3 inner layer (axial core material)
10 centrifugally cast composite roll for rolling

What is claimed is:

1. A centrifugally cast composite roll for rolling having an outer layer, the outer layer comprising chemical components by mass ratio:

C: 1.5 to 3.5%;
Si: 0.3 to 3.0%;
Mn: 0.1 to 3.0%;
Ni: 1.0 to 6.0%;
Cr: 1.5 to 6.0%;
Mo: 0.1 to 2.5%;
V: 2.0 to 6.0%;
Nb: 0.1 to 3.0%;
B: 0.001 to 0.2%;
N: 0.005 to 0.070%; and the balance comprising Fe and inevitable impurities, wherein:

a chemical composition of the outer layer satisfies following Formula (1) and has 5 to 30% of $M_3C$ carbide by area ratio;

an outer layer Shore hardness (A) of a roll surface satisfies following Formula (2); and a residual stress (B) of the roll surface satisfies following Formula (3), $$2\times Ni+0.5\times Cr+Mo>10.0 \quad (1)$$

$$Hs\ 75\leq A\leq Hs\ 85 \quad (2)$$

$$100\ MPa\leq B\leq 350\ MPa \quad (3).$$

2. The centrifugally cast composite roll for rolling according to claim 1, wherein the outer layer further comprises one or more of chemical components by mass ratio:

Ti: 0.005 to 0.3%;
W: 0.01 to 2.0%;
Co: 0.01 to 2.0%; and
S: 0.3% or less.

3. A method of manufacturing the centrifugally cast composite roll for rolling according to claim 1, wherein in a thermal treatment performed after casting by a centrifugal casting method, a tempering treatment is performed without performing a quenching treatment, the tempering treatment being performed at a tempering temperature of 400° C. or higher and 550° C. or lower.

4. A method of manufacturing the centrifugally cast composite roll for rolling according to claim 2, wherein in a thermal treatment performed after casting by a centrifugal casting method, a tempering treatment is performed without performing a quenching treatment, the tempering treatment being performed at a tempering temperature of 400° C. or higher and 550° C. or lower.

* * * * *